United States Patent [19]

Bowers

[11] 4,390,363

[45] Jun. 28, 1983

[54] CONTINUOUS METHOD FOR REMOVING COPPER FROM LEAD

[75] Inventor: John E. Bowers, Oxford, England

[73] Assignee: B.N.F. Metals Technology Centre, Oxfordshire, England

[21] Appl. No.: 272,523

[22] Filed: Jun. 11, 1981

[30] Foreign Application Priority Data

Jun. 18, 1980 [GB] United Kingdom ..... 8019930

[51] Int. Cl.[3] ..... C22B 13/06

[52] U.S. Cl. ..... 75/63; 75/78; 266/235

[58] Field of Search ..... 75/78, 63; 266/235

[56] References Cited

U.S. PATENT DOCUMENTS

| | | | |
|---|---|---|---|
| 1,522,765 | 1/1925 | Wilke | 266/235 |
| 1,922,301 | 8/1933 | Kekich | 75/78 |
| 4,042,228 | 8/1977 | Ward et al. | 266/235 |
| 4,073,481 | 2/1978 | Lawson et al. | 266/235 |

*Primary Examiner*—M. J. Andrews

*Attorney, Agent, or Firm*—Wenderoth, Lind & Ponack

[57] ABSTRACT

A continuous method and apparatus for removing copper from lead comprises introducing molten lead and sulphur to the upper end of a vertical stirred reaction vessel, maintaining a dispersion of sulphur in the lead without substantial back-mixing and thereafter recovering the dispersion and allowing the formed copper sulphide to float to the surface. The process is suitable for continuous operation on a small scale, e.g. 3 tons per hour, is environmentally acceptable and requires a lead inventory only about one third of that required by conventional batch processes.

10 Claims, 2 Drawing Figures

CONTINUOUS METHOD FOR REMOVING COPPER FROM LEAD

Figure 1:
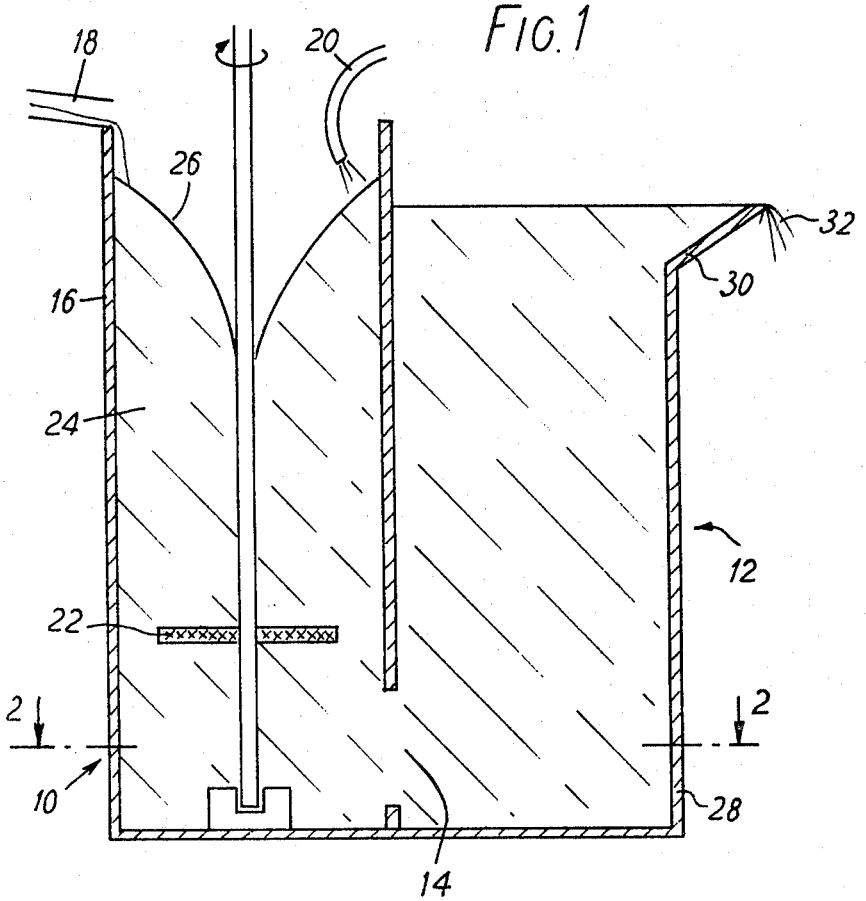

The use of sulphur to remove dissolved copper from molten lead by formation of a copper sulphide dross which floats to the surface of the lead has been well known for many years. The process has conventionally been performed as a batch operation by adding to the molten lead the amount of sulphur required for reaction with the copper, stirring for 5 to 15 minutes to maintain the sulphur in dispersion and effect reaction with the copper, allowing the lead to stand so that the copper sulphide dross floats to the top and recovering refined lead from below the dross.

The equilibrium concentration of copper in lead in the presence of sulphides of copper and lead is about 0.05% at 330° C., depending on the other elements present, but rises rapidly with temperature, so that it is desirable to keep the temperature of the molten lead as low as possible (above its melting point of 327° C. or less). However, this thermodynamic equilibrium is only reached slowly; the initial reaction between the copper and the sulphur takes the dissolved copper concentration down to much lower values; and by stopping the reaction at the correct time it is possible to recover lead containing as little as 0.001% of copper.

A process has been proposed in British patent specification No. 1,524,474, for performing this refining operation on a continuous basis. The described process comprises continuously adding sulphur and molten lead to a first agitated reaction stage; continuously transferring molten lead, copper sulphide dross and unreacted sulphur to at least one further agitated reaction stage; and separating dross from the decoppered lead.

A disadvantage of this process is that each agitated reaction stage is homogeneous. Now the rate of reaction of copper with sulphur in molten lead is initially rapid but slows down greatly as the concentrations of free sulphur and free copper are reduced. A homogeneous mixture therefore reacts more slowly than one whose composition is continuously changing as reaction takes place. Moreover, the selectivity of the reaction, as well as removal rate, is better when the copper concentration is high. If the output is to be of a low copper content and the reactor is homogeneous, the reaction occurs in low copper content lead; this produces a high lead content dross and is thus less efficient than reacting a high copper lead. In order to avoid these problems, the Patentees use a series of reaction stages. But this is not very efficient, since the major part of the reaction probably takes place in the first stage, and requires relatively expensive equipment. It is believed that the Patentees have not put their process into commercial operation.

According to the present invention, these problems may be overcome by performing the reaction under non-homogeneous conditions. As a result, decoppering can be carried out continuously in a single reaction stage.

Advantages of this process are that it may be carried out continuously on a small scale; that it is (or can readily be made) environmentally acceptable; and that it requires a lead inventory only about $\frac{1}{3}$ that required by conventional batch processes.

The present invention provides in one aspect a continuous method of removing copper from lead, which method comprises introducing a stream of lead containing copper as an impurity to the upper end of a vertical stirred reaction vessel, feeding sulphur into the stream of lead at the upper end of the vessel, maintaining a dispersion of sulphur in the stream without substantial back-mixing for a time sufficient to effect reaction between the sulphur and the copper, recovering the stream of lead from the lower end of the vessel, and allowing the formed copper sulphide to float to the surface of the molten lead.

Because of the great difference in density between sulphur and lead, continued agitation is necessary to keep the sulphur in dispersion and prevent it from floating to the surface and catching fire. We achieve this by using a stirred vertical reactor in which the stream of lead is caused to follow a spiral path from top to bottom.

This invention thus provides in another aspect, apparatus for performing the method defined above, comprising a generally U-shaped reactor having an upstream arm joined to a downstream arm at their lower ends, the said upstream arm comprising an elongated vertical vessel of circular cross-section, means for feeding a stream of molten lead to the upper end of the vessel, means for feeding sulphur into the stream of lead at the upper end of the vessel, and an axial impeller to cause the stream of molten lead to follow a generally spiral path down the vessel without substantial back-mixing, and the said downstream arm comprising a vessel extending to approximately the same height as the upstream arm and having an outlet at the upper end thereof.

The upstream arm of the reactor is preferably a cylindrical vessel having a length to diameter ratio of from 2:1 to 10:1. In a vessel having a length to diameter ratio below 2:1, it would be difficult to keep the sulphur in suspension for a sufficient length of time without substantial back-mixing. Vessels having length to diameter ratios greater than 10:1 could in principle be used but are likely in practice to be expensive and difficult to maintain.

The axial impeller is preferably positioned towards the lower end of the vessel. A speed of rotation of at least 60 r.p.m. is probably necessary to keep the sulphur in suspension. The optimum speed will depend on the diameter of the vessel and other factors but is likely to be in the range 100 r.p.m. to 3000 r.p.m. It is believed that, under steady state operation, the body of molten metal in the vessel circulates at a rate approaching that of impeller. However, friction at the walls leads to continuous shearing of the streams of metal and continuously introduces the dispersed sulphur to new regions of molten metal.

It is preferred to use an impeller which imparts horizontal rotational impetus to the molten lead, but little or no vertical impetus. Under these circumstances, the vertical movement of the lead in the vessel is controlled mainly by the rate at which it is introduced at the top and removed from the bottom. The stream of lead follows a generally spiral downward path with no tendency for back-mixing. If an impeller is used which imparts a degree of vertical impetus to the molten metal, then other parameters may need to be adjusted to avoid back-mixing.

The amount of sulphur used should be at least sufficient for complete reaction with the copper present. Additional sulphur merely removes lead by formation of lead sulphide dross, and is accordingly not desired. A typical secondary lead refiner may have a throughput of 1 to 5 tons per hour of lead containing 0.04% to 0.1% of copper. The amount of sulphur required is typically 0.1% to 0.2% of the molten metal, i.e. 1 to 10 kg per hour. The lead is introduced at the periphery of the vessel at its upper end. Rotation of the impeller induces a deep vortex in the surface of the swirling stream of molten lead. The sulphur is fed into this swirling stream of lead, suitably in particulate form entrained in a stream of air.

The upstream and downstream arms of the reactor are joined at their lower ends by a passage of a size to take all the molten metal and formed dross. The downstream arm is a vessel whose size and shape are not critical and which is preferably maintained quiescent to permit the sulphide dross to float to the surface. The dross is removed via an outlet at the upper end of the vessel. It could be possible in principle to remove decoppered lead separately; in practice, it is generally more convenient to transfer dross and lead together to another vessel for separation. The level of the outlet controls the level of molten metal in the upstream arm of the reactor.

For efficient performance, the time of contact between sulphur and sulphides on the one hand and molten lead on the other should preferably be in the range 5 to 25 minutes. Shorter contact times may not be sufficient for complete reaction of the sulphur. Longer contact times may result in a higher final concentration of copper in the decoppered lead. However, contact time in this context is rather less than residence time in the reactor, because there is not very intimate contact between lead and dross under quiescent conditions. Good results may be obtained when the residence time of molten metal in the upstream arm of the reactor is in the range 4 to 20 minutes.

We prefer to maintain the reactor at a temperature 5° to 20° C. above the melting point of the metal being treated.

Figure 2:
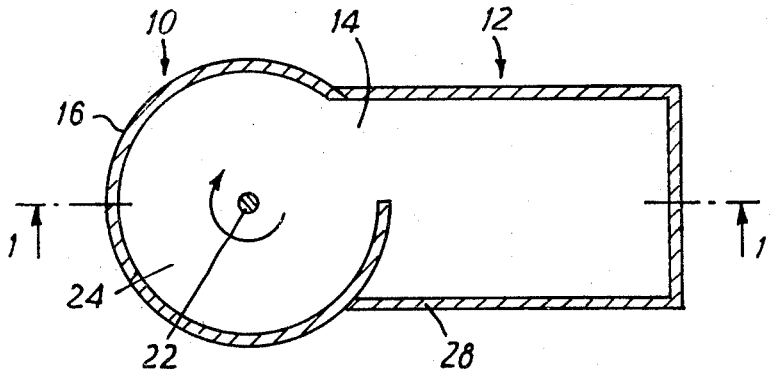

In the accompanying drawings:

FIG. 1 is a vertical cross-section through a reactor according to the invention, on the line 1—1 of FIG. 2; and FIG. 2 is a horizontal cross-section through the reactor, on the line 2—2 of FIG. 1.

Referring to the drawings, the U-shaped reactor comprises an upstream arm 10 joined to a downstream arm 12 by a hole 14 having an area of 6000 $mm^2$ at their lower ends. The upstream arm 10 consists of a vertical cylindrical vessel 16 measuring 900 mm long by 200 mm diameter, i.e. having a length to diameter ratio of 4.5:1, a pipe 18 for feeding molten lead into the periphery of the vessel at its upper end; and a pipe 20 for injecting sulphur into the stream of lead at the upper end of the vessel. An axial impeller 22 is positioned 100 mm above the bottom of the vessel and is caused to rotate at 700 r.p.m., causing the body of molten lead 24 in the vessel to rotate also and creating a deep vortex at the surface 26 of the lead. The impeller is inclined at only 10° to the vertical so that there is little downward thrust. The hole 14 between the upstream and downstream arms of the reactor is tangential to encourage flow therethrough of both lead and dross.

The downstream arm 12 of the reactor consists of a vessel 28, not provided with means for agitation, extending to substantially the same height as the upstream arm 10 and having a weir 30 over which metal and dross 32 are removed. If desired, a paddle can be positioned adjacent the weir 30 to help push dross over the weir.

In operation, 3 tons per hour of molten secondary lead are introduced at 18 as a continuous stream which follows a spiral path down the vessel 16 substantially without back-mixing. The residence time of molten metal in each of the two arms of the reactor is about 5 minutes making 10 minutes in all. A mixture of lead and dross is removed over the weir 30 at a rate of 3 tons per hour, and transferred to a settling vessel (not shown) where the sulphide dross floats to the surface and is separated from the molten lead.

EXAMPLE 1

Lead bullion containing 0.065% of copper was passed for 105 minutes at a temperature of 327° C. and a rate of 3 tons per hour through the apparatus described above. The supply of sulphur was 0.6 kg per hour. The recovered lead had a copper content of 0.009%.

EXAMPLE 2

Lead bullion containing 0.063% of copper was passed for 170 minutes at a temperature of 341° C. and a rate of 3 tons per hour through the apparatus. The supply of sulphur was 1.0 kg per hour. The recovered lead had a copper content of 0.004%.

I claim:

1. A continuous method of removing copper from lead by reaction of copper with sulfur in a single stirred reaction vessel in which the materials introduced into the vessel are maintained under non-homogeneous conditions, which method comprises introducing a stream of lead containing copper as an impurity to the upper end of a vertical stirred reaction vessel, feeding sulphur into the stream of lead at the upper end of the vessel, maintaining a dispersion of sulphur in the stream without substantial back-mixing for a time sufficient to effect reaction between the sulphur and the copper, recovering the stream of lead from the lower end of the vessel, and allowing the formed copper sulphide to float to the surface of the molten lead.

2. A method as claimed in claim 1, wherein the stream of lead has a throughput of from 1 to 5 tons per hour, and sulphur is supplied at a rate of from 1 to 10 kg per hour.

3. A method as claimed in claim 1 or claim 2, wherein sulphur in particulate form is fed entrained in a stream of air into the molten lead.

4. A method as claimed in any one of claims 1 to 3, wherein the total contact time between sulphur-bearing materials and molten lead is from 5 to 25 minutes.

5. A method as claimed in any one of claims 1 to 4, wherein the residence time of the molten lead in the vertical stirred reaction vessel is from 4 to 20 minutes.

6. A method as claimed in any one of claims 1 to 5, wherein the molten lead is maintained at a temperature from 5° to 20° C. above its melting point.

7. A method as claimed in claim 1, wherein the vertical stirred reaction vessel is an elongated vessel of circular cross-section, and the contents of the vessel are stirred by means of an axial impeller to cause the stream of molten lead to follow a generally spiral path down the vessel without substantial back-mixing.

8. A method as claimed in claim 7, wherein the vertical stirred reaction vessel is a cylindrical vessel having a length to diameter ratio of from 2:1 to 10:1.

9. A method as claimed in claim 7, wherein the impeller is rotated at from 100 to 3000 r.p.m.

10. A method as claimed in claim 1, wherein the stream of lead is recovered from the lower end of the reaction vessel by means of a hole arranged tangential thereto.

* * * * *